US010151127B1

(12) United States Patent
Shell

(10) Patent No.: US 10,151,127 B1
(45) Date of Patent: Dec. 11, 2018

(54) PORTABLE DOOR LOCK

(71) Applicant: Rebecca LeAndra Shell, Birmingham, AL (US)

(72) Inventor: Rebecca LeAndra Shell, Birmingham, AL (US)

( * ) Notice: Subject to any disclaimer, the term of this patent is extended or adjusted under 35 U.S.C. 154(b) by 193 days.

(21) Appl. No.: 15/350,348

(22) Filed: Nov. 14, 2016

Related U.S. Application Data

(60) Provisional application No. 62/358,438, filed on Jul. 5, 2016.

(51) Int. Cl.
*E05C 19/18* (2006.01)

(52) U.S. Cl.
CPC ..... *E05C 19/182* (2013.01)

(58) Field of Classification Search
CPC ..... E05C 19/182
See application file for complete search history.

(56) References Cited

U.S. PATENT DOCUMENTS 112,320 A * 3/1871 Caldwell ..... E05C 19/182 292/292
2,536,941 A * 1/1951 Jones ..... E05C 19/182 292/1
3,411,817 A 11/1968 Carver
4,082,335 A 4/1978 Smith
4,326,394 A * 4/1982 Stein ..... E05C 19/182 292/292
4,330,146 A 5/1982 Sessions
4,589,692 A 5/1986 Boyd
4,653,785 A * 3/1987 Tobey ..... E05C 19/182 29/897.3
4,653,786 A 3/1987 Bopst
4,964,662 A * 10/1990 O'Leary ..... E05C 19/182 292/295
5,193,866 A * 3/1993 Driskill ..... E05C 19/182 292/292
5,280,977 A 1/1994 Piva
5,415,444 A 5/1995 Hull
5,542,723 A * 8/1996 Scharf ..... E05C 17/54 292/258
5,566,993 A 10/1996 Olivas
5,685,580 A * 11/1997 West ..... E05C 19/182 292/288
5,794,871 A 8/1998 Willetts
5,810,404 A * 9/1998 Home ..... E05C 19/182 292/288
5,865,484 A * 2/1999 Johns ..... E05C 19/182 292/288
6,036,242 A * 3/2000 Lin ..... E05C 19/182 292/288

(Continued)

*Primary Examiner* — Katherine W Mitchell
*Assistant Examiner* — Catherine A. Kelly
(74) *Attorney, Agent, or Firm* — Shane V. Cortesi

(57) ABSTRACT

The present invention relates to a keyless portable lock for a door. The portable door lock includes a horizontal bar that lays across the door and/or the door frame and a strap with one or more holes. The user pulls on the strap, closes the door and inserts a rod through the one or more strap holes so that the rod lays across the door and the frame on the opposite side of the door as the horizontal bar. This action will prevent the door from being opened. A transverse bar may extend from the horizontal bar at approximately 90 degree angle so that the portable door lock is generally in the shape of a L.

11 Claims, 10 Drawing Sheets

(56) References Cited

U.S. PATENT DOCUMENTS

| | | | | |
|---|---|---|---|---|
| 6,182,485 | B1 | 2/2001 | Moore | |
| 8,510,994 | B2 * | 8/2013 | Scott | E05B 9/08 292/289 |
| 2004/0026935 | A1 | 2/2004 | Tang | |
| 2013/0180294 | A1 * | 7/2013 | Pomerantz | E05C 19/182 70/20 |

* cited by examiner

PORTABLE DOOR LOCK

RELATED APPLICATIONS

This application claims priority under 35 USC 119 to U.S. Application No. 62/358,438, entitled PORTABLE DOOR LOCK, filed Jul. 5, 2016.

BACKGROUND

Technical Field

The present invention relates to portable devices for locking doors.

Background of the Invention

Doors have been used for centuries to open and close rooms and homes. Traditionally, a door is able to be locked from the inside of the room but not the outside of the room.

Traditional door locks have many problems, however. For example, locks may be able to be picked by burglars. In addition, when one is staying in a hotel without a dead bolt, the hotel operator may have a master key to open the hotel guest's room.

U.S. Pat. No. 4,330,146 to Sessions, Jr. describes a door lock that is designed to secure a door from both sides temporarily while the building is being vacated. The portable door lock is comprised of Part A having a bar portion having a series of holes at one end, and, at the other end, a portion angled to form an L shape with. Part B is comprised of a bracket, which has holes which match those in bar portion, and an arm pivoted at 6 to the bracket. This arm has a pin extending toward portion. The parts which form the door lock are of steel. In use, a hole is drilled in the outside door facing or wall adjacent to the latch edge of the door. The portable door lock is slid under the door and the pin is placed in the hole drilled in the door.

Among other disadvantages, U.S. Pat. No. 4,330,146 requires drilling a hole in the door.

Additional door locking devices are shown in U.S. Pat. No. 5,542,723 to Scharf and U.S. Pat. No. 5,810,404 to Horne. However, both devices may not be able to be used in door frames of various shapes and sizes. For example, FIG. 7 of Horne shows an angled orientation of the described locking member.

Thus, there is a need for new door lock systems, particularly those that don't damage the door.

BRIEF SUMMARY

The present disclosure provides a keyless portable door lock. In some embodiments, the present invention provides a method of locking a door with a portable door lock comprising:

a) providing a door frame comprising a front side, a rear side, a door frame thickness extending from the front side to the rear side, a left side, a right side, a width extending from the left side to the right side, a top side, a bottom side, a frame height extending from the top side to the bottom side, and a door opening located between the left side, right side, top side, and bottom side;

b) providing a door comprising a door front side, a door rear side, a door thickness extending from the door front side to the door rear side, a door left side, a door right side, a door width extending from the door left side to the door right side, a door top, a door bottom, and a door height extending from the door top to the door bottom, the door configured to pivot along a pivot axis from a closed position in which the door covers the door opening and the door width is substantially parallel to the door frame width to an open position in which the door does not cover the door opening and in which the door width is not substantially parallel to the door frame width;

c) providing a portable door closer comprising a horizontal bar and a strap connected (through direct or indirect attachment) to the horizontal bar, the strap comprising at least one hole;

d) positioning the horizontal bar at least partially across the door front side and/or the front side of the frame while the door is in the open position so that the horizontal bar contacts the door front side and/or the frame front side;

e) pulling the strap rearwardly;

f) after at least step d (i.e, after step d or e), moving the door to the closed position; and g) positioning a rod through the at least one hole so that the rod contacts the door rear side and the door frame rear side and prevents the door from moving to the open position.

Optionally, the rod has a left end, a right end, and a length extending from the left end to the right end and step g) comprises positioning the rod through the at least one hole so that the rod length is substantially parallel to the door frame width and the door width. Optionally, at least in step g (i.e., during or prior to step g), the strap end and at least one strap hole is located to the rear of the door. Optionally, the rod has an adjustable length. Optionally, the strap comprises a front, a rear, a strap length extending from the front to the rear, and further wherein the strap comprises a plurality of holes spaced along the strap length and further wherein the plurality of holes have substantially the same diameter. Optionally, the portable door closer further comprises a transverse bar extending from the horizontal bar at an angle of between about 80 and 100 degrees relative to the horizontal bar, and further wherein the method further comprises extending the transverse bar at least partially along the door frame thickness and at least partially along the door thickness when the door is in the closed position. Optionally, the horizontal bar and the transverse bar form a T or L shape. Optionally, the horizontal bar comprises a left side, a right side, a horizontal bar width extending from the left side to the right side. Optionally, the horizontal bar width is generally parallel to the door width when the door is in the closed position. Optionally, the horizontal bar width is between about 1 and about 5.5 inches. Optionally, the transverse bar has a front end extending from the horizontal bar, a rear end opposite the front end, a length extending from the front end to the rear end and further wherein the transverse bar length is between about 1 inches and about 5.5 inches. Optionally, the horizontal bar and the transverse bar are comprised of coated metal. Optionally, the horizontal bar and the transverse bar are comprised of metal or plastic. Optionally, the strap extends between about 7 and about 14 inches beyond the transverse bar rear. Optionally, the at least one hole is a grommet hole. Optionally, the holes are substantially circular in shape and comprise a diameter of between about 0.25 and about 0.5 inches. Optionally, the rod is comprised of metal or plastic. Optionally, the rod is substantially cylindrical in shape and comprises a diameter of between about 0.25 and about 0.5 inches and a length of about 3 inches to about 9 inches. Optionally, the strap is pliable. Optionally, the at least one hole comprises a hole diameter, wherein the at least one rod comprises a rod diameter, and further wherein the at least one hole diameter is substantially equal in size in to the rod diameter. Optionally, the portable door lock is located inside a travel bag. Optionally, the strap loops through a hole in the transverse bar, adjacent to the transverse bar rear end.

In still further embodiments, the present disclosure provides a portable door lock system comprising:

a) a generally cylindrical rod having a front end, a rear end, a length extending from the front end to the rear end, and a diameter perpendicular to the length;

b) a door closer bar in the form of a L and comprising a horizontal bar, and a transverse bar extending from the horizontal bar at an angle of between about 80 and 100 degrees relative to the horizontal bar, wherein the horizontal bar comprises a left side, a right side, a horizontal bar width extending from the left side to the right side; and c) a pliable strap comprising a front, a rear, a strap length extending from the front to the rear, and a plurality of holes spaced about the strap length, the pliable strap extending from the transverse bar, the plurality of holes generally circular in shape and comprising a diameter, wherein the diameters of each of the holes is substantially equal in size to the diameter of the generally cylindrical rod.

Optionally, the portable door lock system may also include one or more features of the prior embodiment, including without limitation the adjustable length, the grommet holes, the dimensions, the materials recited above, and the travel bag.

BRIEF DESCRIPTION OF THE DRAWINGS

FIG. 1 is taken from the exterior of the room and the door is in the closed position.

FIG. 2 is taken from the exterior of the room and the door is in the open position.

FIG. 3 is taken from the interior of the room and the door is in the closed position.

in FIG. 11, the door is open.

in FIG. 12, the door is closed.

in FIG. 13, the door is closed.

DETAILED DESCRIPTION

Figure 1:
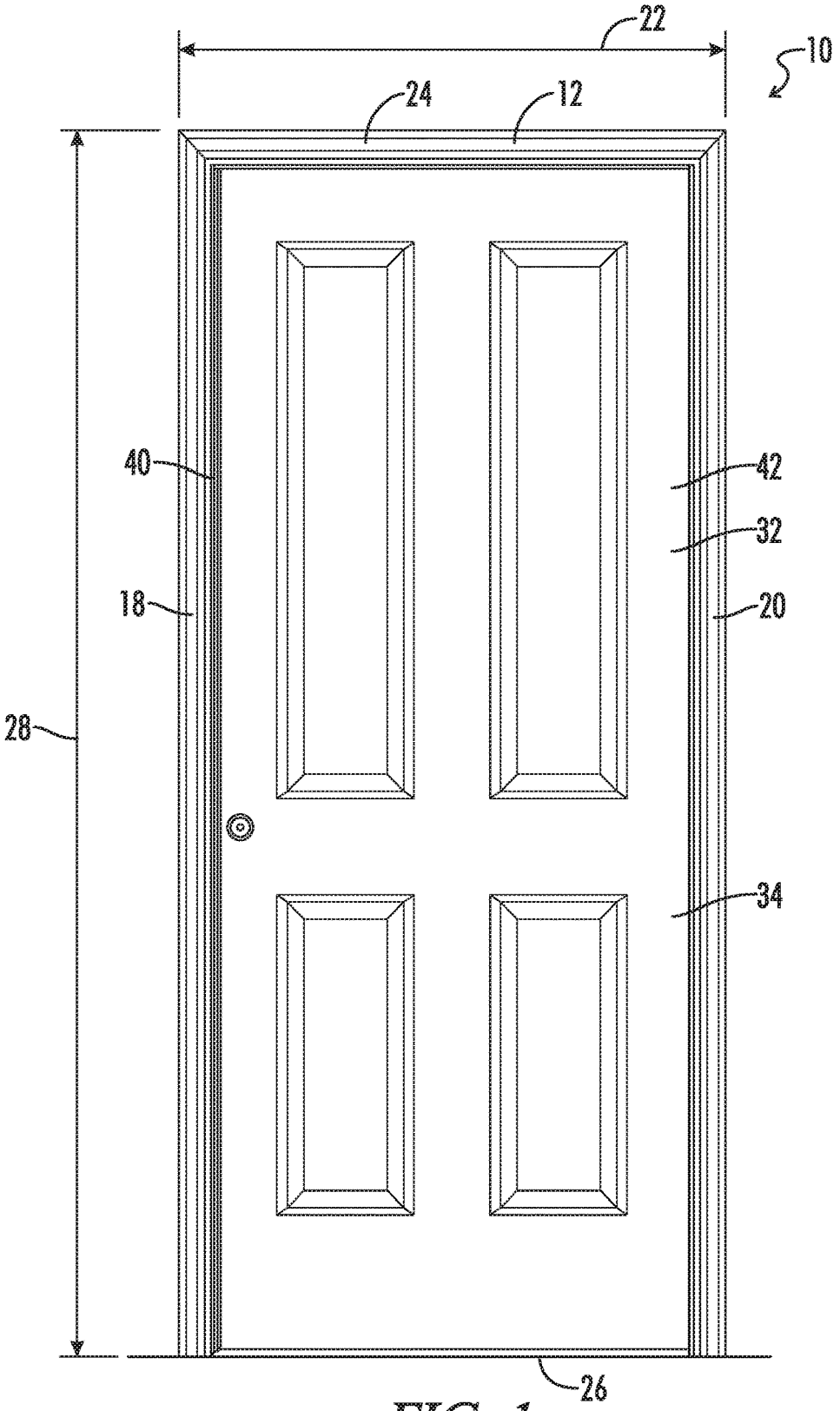
FIG. 1 illustrates a front elevation view of a typical door.

With reference to FIGS. 1-10, the present invention provides a portable door lock system. In the drawings, not all reference numbers are included in each drawing for the sake of clarity.

Figure 2:
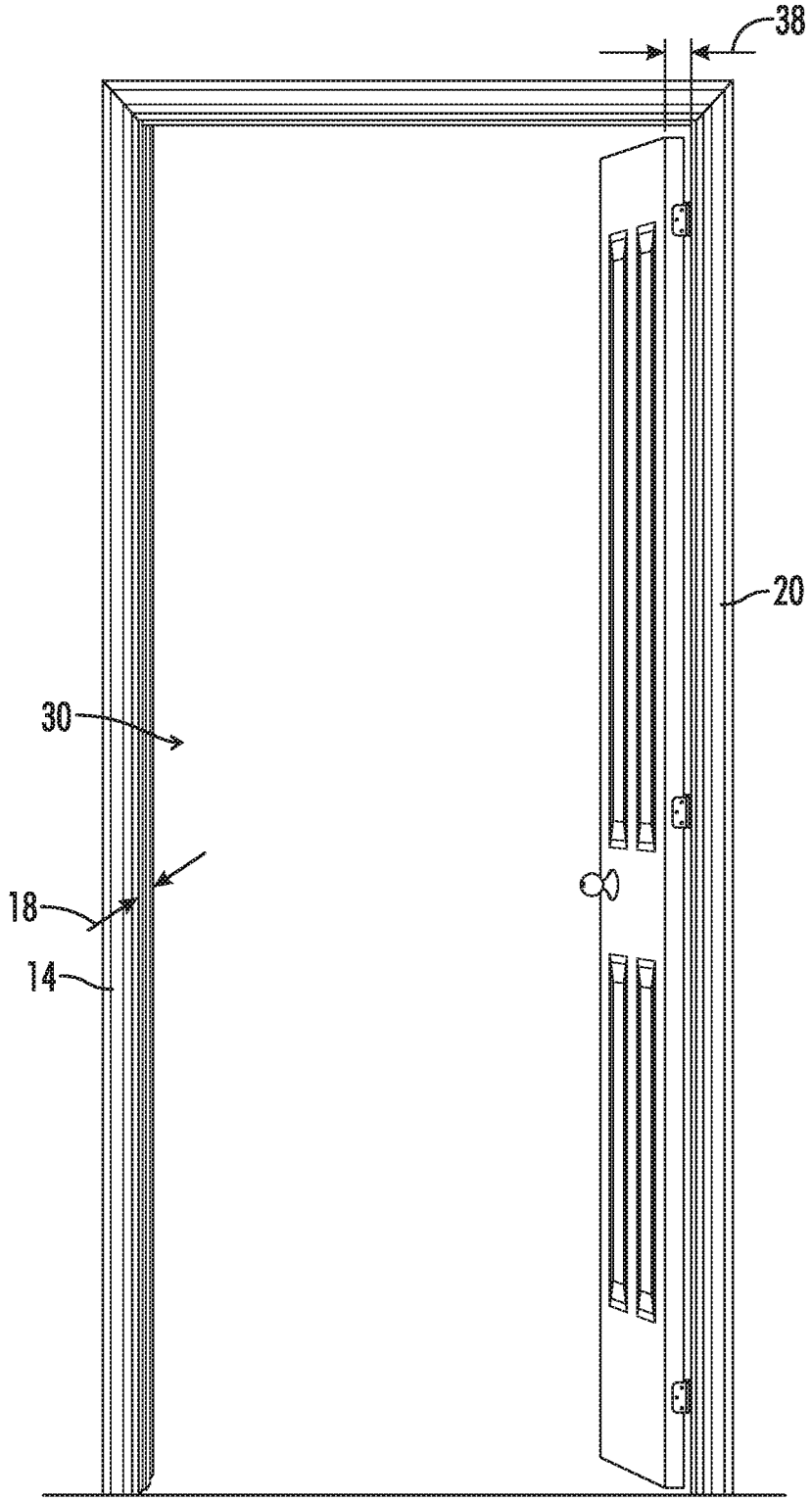
FIG. 2 illustrates a front elevation view of the door of FIG. 1.
Figure 3:
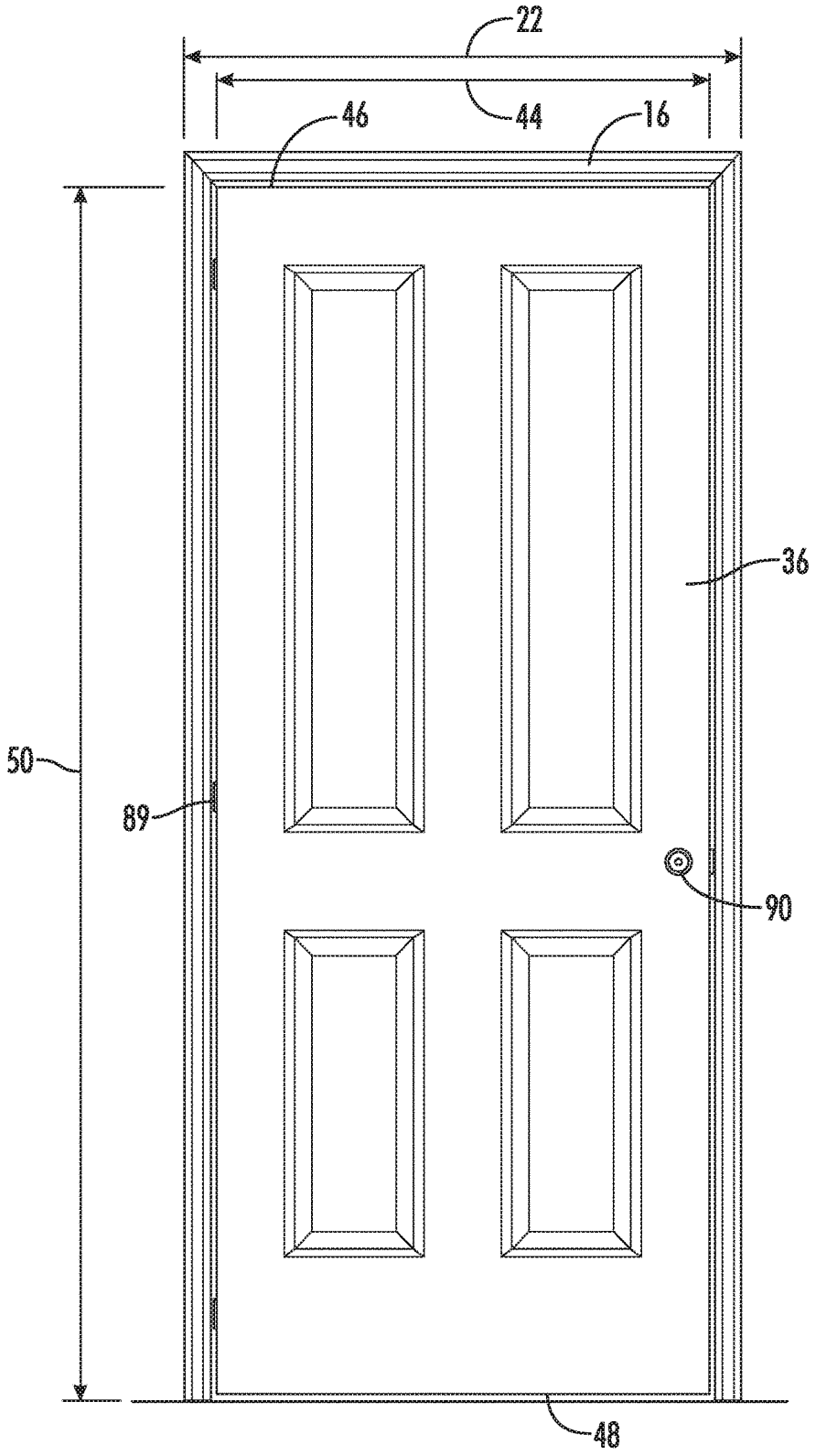
FIG. 3 illustrates a rear elevation view of the door of FIG. 1.

Referring further to FIGS. 1-10, in some embodiments, the system includes a door frame 12 comprising a front side 14, a rear side 16, a door frame thickness 18 extending from the front side 14 to the rear side 16, a left side 18, a right side 20, a width 22 extending from the left side 18 to the right side 20, a top side 24, a bottom side 26, a frame thickness 28 extending from the top side 24 to the bottom side 26 and a door opening 30 located between the left side 18, right side 20, top side 24, and bottom side 26. It will be understood that the frame bottom side 26, may be the ground as shown in FIGS. 1-3. In addition, it will be understood that the frame 12 can be any suitable shape. However, a rectangular door frame, as shown in FIGS. 1-3 is preferred.

The system further includes a door 32 having a door front side 34, a door rear side 36, a door thickness 38 extending from the door front side 34 to the door rear side 36, a door left side 40, a door right side 42, a door width 44 extending from the door left side 40 to the door right side 42, a door top 46, a door bottom 48, and a door height 50 extending from the door top 46 to the door bottom 48, the door 32 configured to pivot along a pivot axis from a closed position (see FIGS. 1 and 3) in which the door 32 covers the door opening 30 and the door width 44 is substantially parallel to the door frame width 22 to an open position (see FIG. 2) in which the door 32 does not cover the door opening 30 and in which the door width 44 is not substantially parallel to the door frame width 22. Typically, the door 32 will pivot through use of a door hinge 89 and the door 32 includes a door knob 90.

Figure 4:
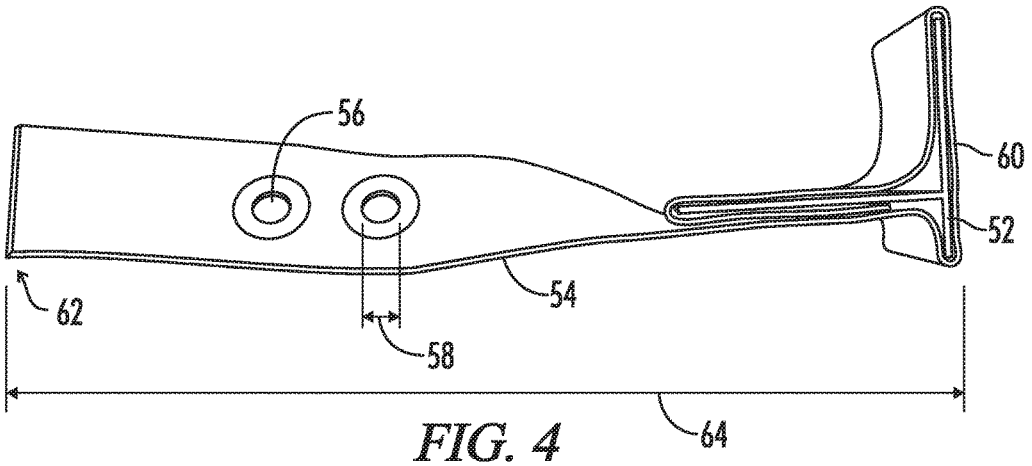
FIG. 4 illustrates a top perspective view of a strap, transverse bar and horizontal bar of a portable door lock of one embodiment of the present invention.
Figure 4A:
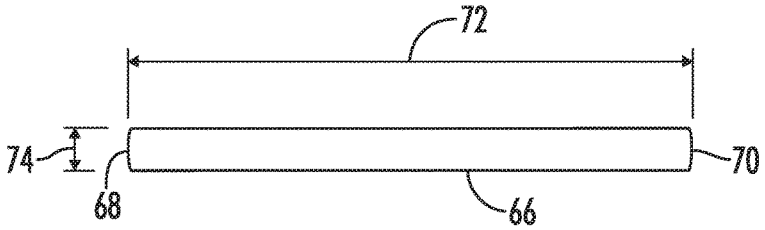
FIG. 4A illustrates a top perspective view of a rod of a portable door lock of one embodiment of the present invention.
Figure 5:
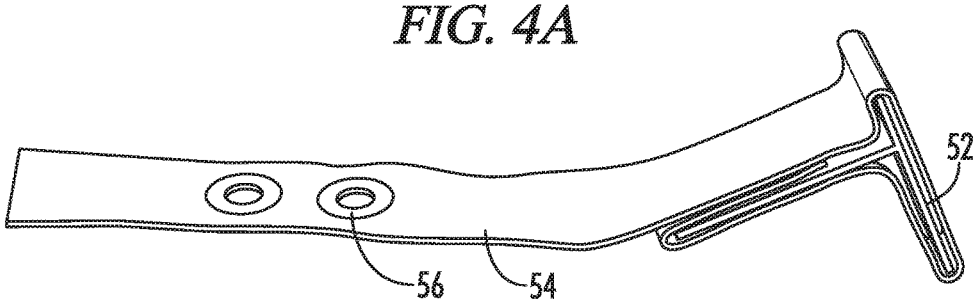
FIG. 5 illustrates a side perspective view of the strap, horizontal bar, and transverse bar of FIG. 4.
Figure 6:
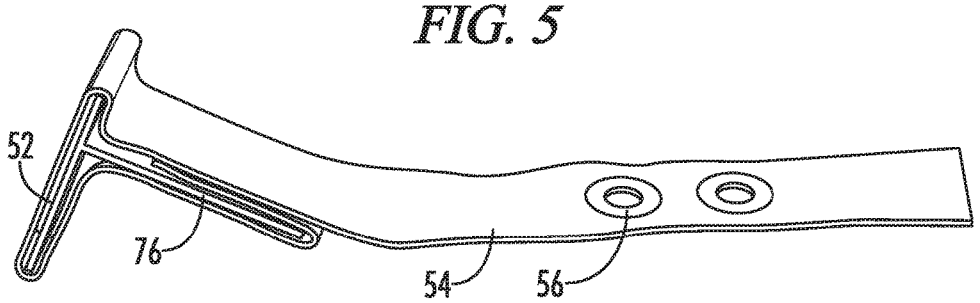
FIG. 6 illustrates a side perspective view of the strap, horizontal bar, and transverse bar of FIG. 4.
Figure 9:
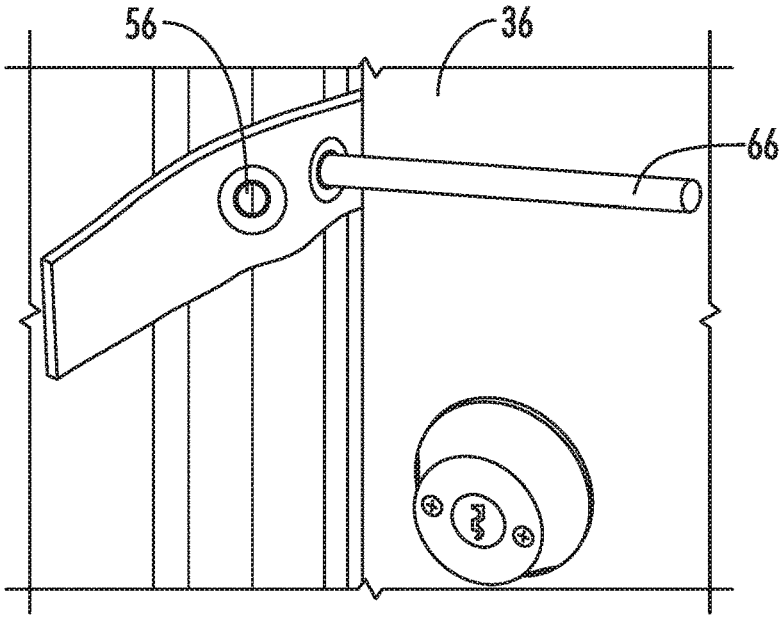
FIG. 9 illustrates a close-up rear perspective view of the portable door lock and door of FIG. 8.
Figure 10:
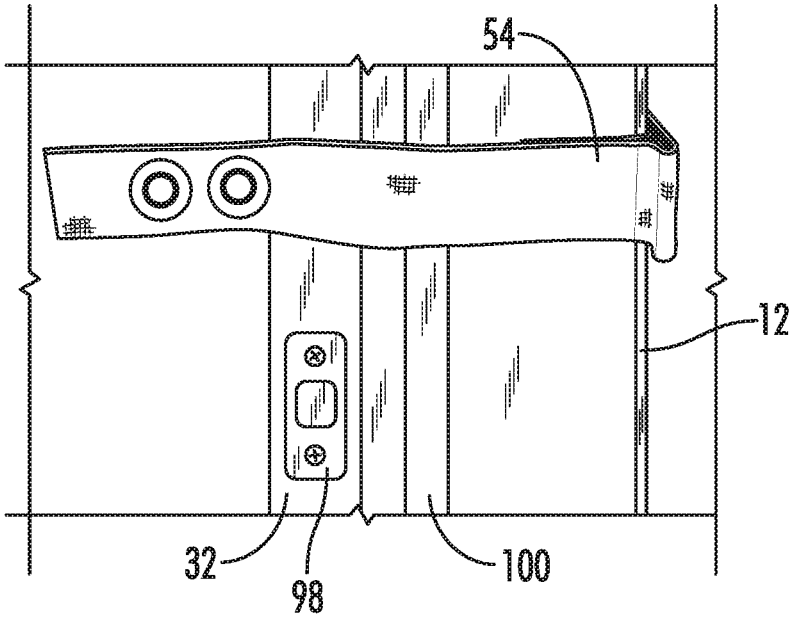
FIG. 10 illustrates a side perspective view of the portable door lock and door frame of FIG. 8.
Figure 11:
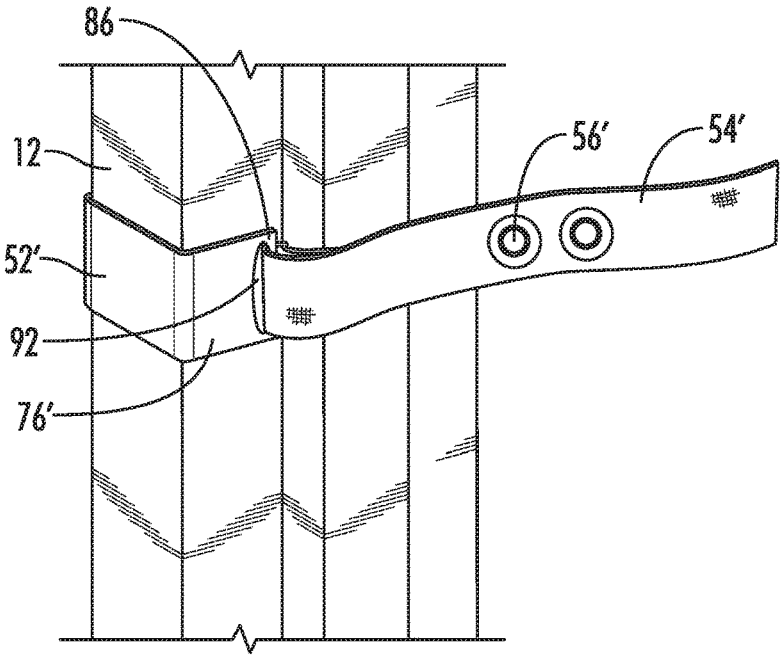
FIG. 11 illustrates a front perspective view of a portable door lock of another embodiment of the present invention being used to lock a door.
Figure 12:
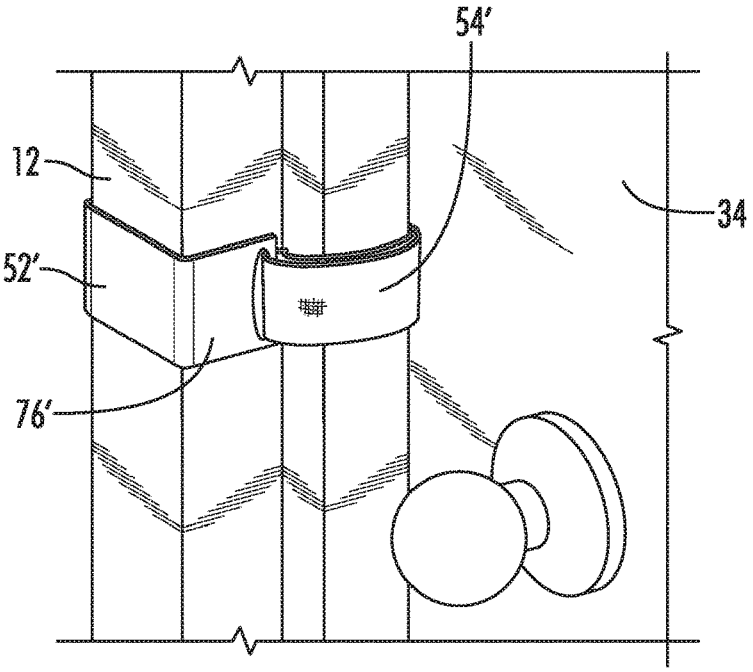
FIG. 12 illustrates a front perspective view of the portable door lock and frame of FIG. 11.

The system further includes portable door closer comprising a horizontal bar 52 and a strap 54 connected to the horizontal bar 52, the strap 54 comprising at least one hole 56 that extends through the strap 54 (i.e., through the thickness of the strap, as best seen in FIG. 9). Optionally, the strap 54 comprises a front 60 (which may cover the horizontal bar 52), a rear 62, a strap length 64 extending from the front 60 to the rear 62, and the strap several holes 56 spaced along the strap length 64 and each strap hole has substantially the same diameter 58. Optionally, the strap hole(s) 56 is a grommet hole(s) as seen in FIGS. 4, 5 and 9.

Figure 7:
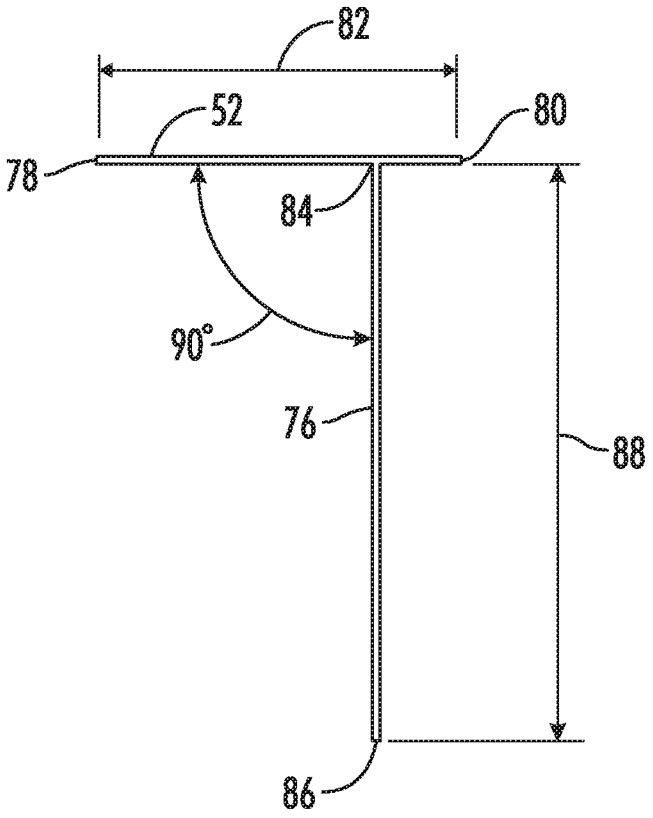
FIG. 7 illustrates a top plan view of a horizontal bar and a transverse bar of a portable door lock of another embodiment of the present invention.

Optionally, the portable door closer further comprises a transverse bar 76 extending from the horizontal bar 52 at an angle of between about 80 and 100 degrees relative to the horizontal bar 52 (e.g., 90 degrees as shown in FIG. 7). Optionally, the horizontal bar 52 and the transverse bar 76 form a T. Optionally, the horizontal bar 52 comprises a left side 78, a right side 80, a horizontal bar width 82 extending from the left side 78 to the right side 80, and further wherein the transverse bar 76 is offset from the center of the horizontal bar width 82, as best seen in FIG. 7 wherein the left side of the horizontal bar 52 (i.e., the area to the left of the transverse bar 76) has a width of about 2 inches to about 4 inches and the right side of the horizontal bar 52 (i.e., the area to the right of the transverse bar 76) has a width of about 0.25 inches to about 1 inch. Optionally, the horizontal bar width 82 is between about 1 and about 3 inches. Optionally, the transverse bar 76 has a front end 84 extending from the horizontal bar 52, a rear end 86 opposite the front end 84, a length 88 extending from the front end 84 to the rear end 86 and further wherein the transverse bar length 88 is between about 1 inches and about 5.5 inches. Optionally, the horizontal bar 52 and the transverse bar 76 are comprised of coated metal. Optionally, the horizontal bar 52 and the transverse bar 76 are comprised of metal or plastic. Optionally, the strap rear 62 extends between about 7 and about 14 inches beyond the transverse bar rear 86.

In use, the horizontal bar 52 is positioned at least partially across the door front side 34 and/or the front side 14 of the frame 12 while the door 32 is in the open position so that the horizontal bar 52 contacts the door front side 34 and/or the frame front side 14, and the strap 54 is pulled rearwardly and the user moves the door 32 to the closed position. The user then inserts a rod 66 through a strap hole 56 so that the rod 66 is adjacent to (and preferably contacts) the door rear side 36 and the door frame rear side 16 and prevents the door 32 from moving to the open position—i.e., prevents the door 32 from pivoting rearwardly.

Figure 8:
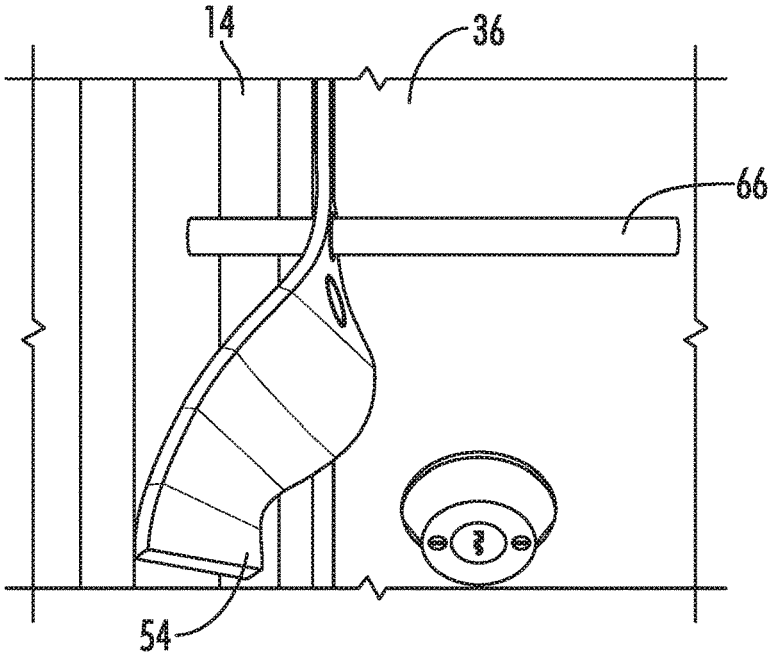
FIG. 8 illustrates a rear perspective view of a portable door lock of another embodiment of the present invention being used to lock a door.

As used herein, the words "front" and "rear" refer to the direction of a component with respect to a user standing in front of the door 32 and door frame 12. Thus, in use, the horizontal bar 52 is the component of the portable door closer that is disposed the furthest in front of the user and the user pulls the strap 54 rearwardly—i.e., towards the user. In addition, the horizontal bar 52 contacts the side of the door and/or frame furthest in front of the user (i.e., the frame front side 12 and/or the door front side 34), whereas the rod 68 contacts the side of the door and the frame closest to the user (i.e., the frame rear side 14 and the door rear side 36). Ordinarily, the door 32 will open rearwardly—i.e., toward the user. As shown in FIG. 8, the strap rear end 62, strap hole 56 and rod 66 are to the rear of the door 32.

Optionally, the rod 66 has a left end 68, a right end 70, and a length 72 extending from the left end 68 to the right end 70 and the user positions the rod 66 through the strap hole 56 so that the rod length 72 is substantially parallel to the door frame width 22 and the door width 44. Optionally, the rod 66 has an adjustable length 72 (e.g., the rod 66 may telescope or may unscrew for portability). Optionally, the rod 66 is comprised of metal or plastic. Optionally, the rod 66 is substantially cylindrical in shape and comprises a diameter 74 of between about 0.25 and about 0.5 inches and a length 72 of about 3 inches to about 9 inches.

Optionally, the strap hole(s) 56 is substantially circular in shape and comprises a diameter 58 of between about 0.25 and about 0.5 inches. Optionally, the strap hole diameter 58 is substantially equal in size in to the rod diameter 74. (e.g., the difference in size between the strap hole diameter 58 and the rod diameter 74 may be between 0.001 inches and about 0.1 inches). Optionally, the strap 54 is pliable. Optionally, the strap 54 is cut-resistant and tear-resistant, e.g. an aramid synthetic fiber such as KEVLAR. The strap 54 may also be woven polyester or nylon, resistant to abrasion with a high breakage strength. Optionally, the strap 54 is comprised of steel, e.g., tempered steel or stainless steel.

Optionally, the user extends the transverse bar 72 at least partially along the door frame thickness 18 and at least partially along the door thickness 38 when the door 32 is in the closed position.

Optionally, the rod 68, horizontal bar 52, and transverse bar 76 are located inside in a travel bag for easy carrying and storage.

The Embodiments of FIGS. 11-14

Figure 13:
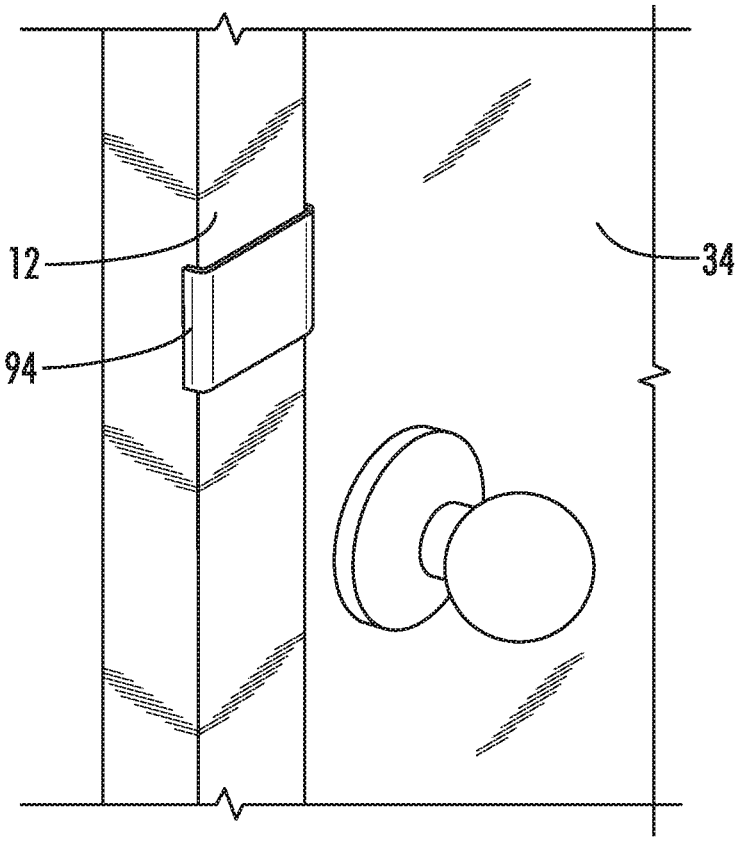
FIG. 13 illustrates a front perspective view of the portable door lock and frame of FIG. 11.
Figure 14:
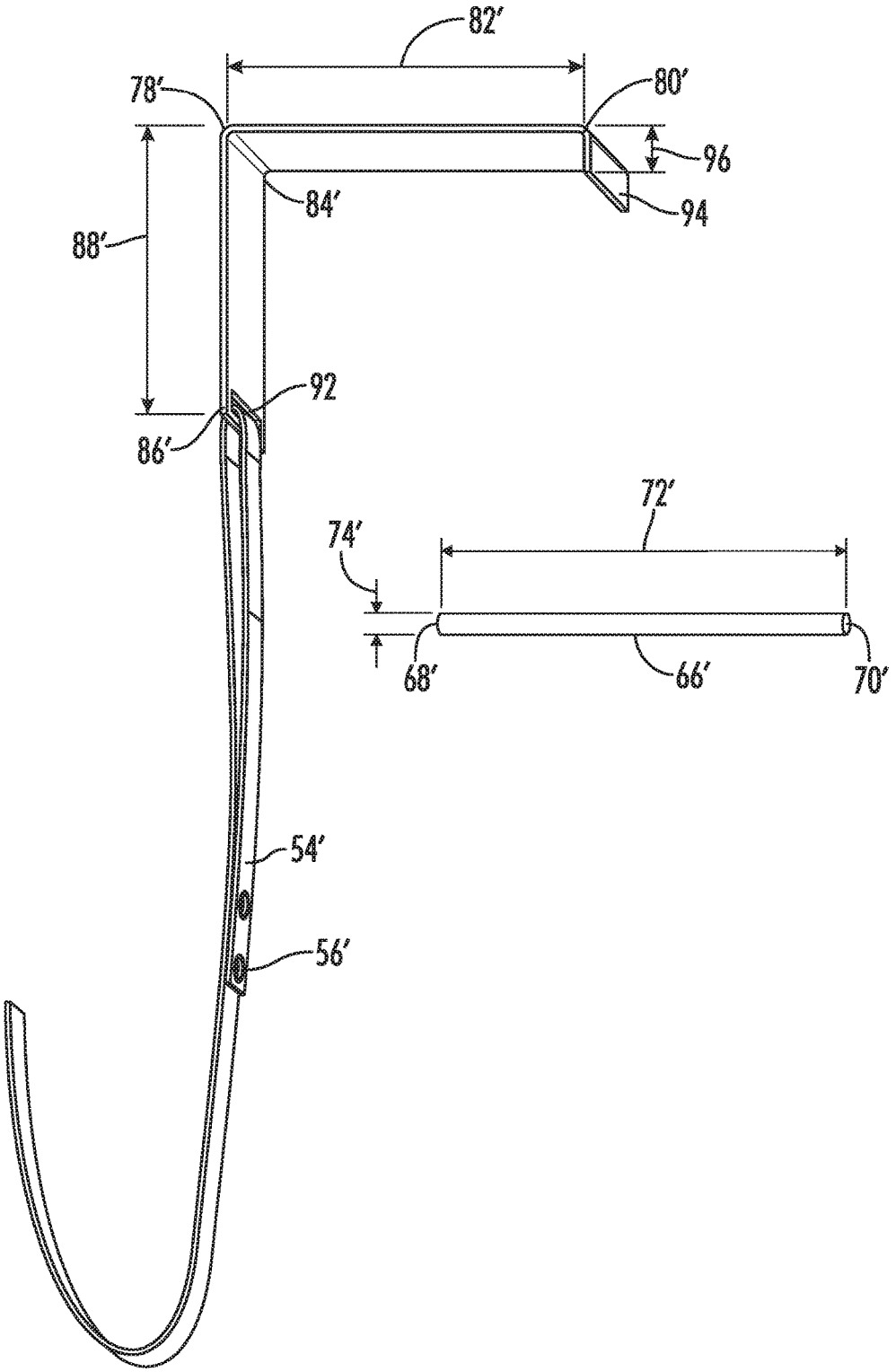
FIG. 14 illustrates a top perspective view of the portable door lock of FIG. 11.

FIGS. 11-14 show an alternate embodiment of the invention. In the drawings of FIGS. 11-14, part numbers of the portable door closer similar to the previous embodiment of FIGS. 1-10 are labelled with an apostrophe after the part number to indicate that they are associated with the embodiments of FIGS. 11-14. In FIGS. 11-14, the portable door closer is in the shape of a "L", as opposed to an offset "T". More particularly, as with the prior embodiment, the portable door closer includes a horizontal bar 52' that contacts the door frame front 14, a transverse bar 76' extending rearwardly from the horizontal bar 52', a removable rod 66' that contacts the door rear 36 and the frame rear 16, and a strap 54' with one or more holes 56' to receive the removable rod 66'. However, in FIGS. 11-14, the transverse bar 76' includes a transverse bar hole 92 adjacent the transverse bar rear end 86'. The strap 54' may be looped through the transverse bar hole 92 so that the strap 54' is connected to the horizontal bar 52' through attachment of the strap 54' to the transverse bar 76' which in turn is attached to the horizontal bar 52' as shown in FIGS. 11-14. The horizontal bar 52' may further include a lip 94 with a lip length 96 of about 0.2 inches to about 1 inch as best seen in FIGS. 13-14 to allow the horizontal bar 52' to be secured the frame front 14. In addition the frame left side 18 or frame right side 20 may include a latch 98 and a flange 100 located in front of the latch 98 that prevents the door 32 from moving forwardly beyond the flange 100 as is typical for most doors 32. Optionally, the horizontal bar width 82' is between about 1 inches and about 5.5 inches. As with the prior embodiment of FIGS. 1-10, in FIGS. 11-14, the transverse bar 76' has a front end 84' extending from the horizontal bar 52', a rear end 86' opposite the front end 84', a length 88' extending from the front end 84' to the rear end 86'. As with the prior embodiment of FIGS. 1-10, in FIGS. 11-14, the horizontal bar 52' comprises a left side 78', a right side 80', a horizontal bar width 82' extending from the left side 78' to the right side 80'. As with the prior embodiments of FIGS. 1-10, in FIGS. 11-14 the rod 66' has a left end 68', a right end 70', and a length 72' extending from the left end 68' to the right end 70'.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of locking a door with a portable door lock comprising:

a) providing a door frame comprising a front side, a rear side, a door frame thickness extending from the front side to the rear side, a left side, a right side, a width extending from the left side to the right side, a top side, a bottom side, a frame height extending from the top side to the bottom side, and a door opening located between the left side, right side, top side, and bottom side;

b) providing a door comprising a door front side, a door rear side, a door thickness extending from the door front side to the door rear side, a door left side, a door right side, a door width extending from the door left side to the door right side, a door top, a door bottom, and a door height extending from the door top to the door bottom, the door configured to pivot along a pivot axis from a closed position in which the door covers the door opening and the door width is substantially parallel to the door frame width to an open position in which the door does not cover the door opening and in which the door width is not substantially parallel to the door frame width;

c) providing a portable door closer comprising a horizontal bar, a transverse bar extending rearwardly from the horizontal bar at an angle of between about 80 and 100 degrees relative to the horizontal bar, a lip extending rearwardly from the horizontal bar and generally parallel to the transverse bar, and a pliable strap connected to the transverse bar, the pliable strap comprising at least one hole, a forward end, a rear end, a middle portion between the forward end and the rear end, and a strap length extending from the forward end to the rear end;

d) resting the horizontal bar across a portion of the door frame front side so that the horizontal bar, in combination with the lip and transverse bar, wrap at least partially around three sides of a portion of the door frame while the door is in the open position;

e) pulling the pulling strap rearwardly;

f) after at least step d, moving the door to the closed position; and g) positioning a rod through the at least one hole so that the rod contacts the door rear side and the door frame rear side and prevents the door from moving to the open position, wherein after step f), i) the door front side is located rearwardly relative to the transverse bar, the horizontal bar, and the strap forward end, ii) a portion of the strap middle portion extends between the door and the frame, and iii) the strap rear end and the at least one hole are located to the rear of the door rear side.

2. The method of claim 1, wherein the rod has a left end, a right end, and a length extending from the left end to the right end and step g) comprises positioning the rod through the at least one hole so that the rod length is substantially parallel to the door frame width and the door width.

3. The method of claim 2, wherein the pliable strap comprises a plurality of holes spaced along the strap length and further wherein the plurality of holes have substantially the same diameter.

4. The method of claim 1, wherein the transverse bar comprises a transverse bar hole and further wherein the strap is looped through the transverse bar hole to connect the strap to the transverse bar.

5. The method of claim 1, wherein the horizontal bar comprises a left side, a right side, a horizontal bar width extending from the left side to the right side, the horizontal bar width generally parallel to the door width when the door is in the closed position and further wherein the transverse bar extends from the horizontal bar left side and the lip extends from the horizontal bar right side.

6. The method of claim 1, wherein the transverse bar has a front end extending from the horizontal bar, a rear end opposite the front end, a length extending from the front end to the rear end and further wherein the transverse bar length is between about 1 inches and about 5.5 inches.

7. The method of claim 6, wherein the strap is attached to the transverse bar adjacent to the transverse bar rear end.

8. The method of claim 1, wherein the at least one hole comprises a hole diameter, wherein the at least one rod comprises a rod diameter, and further wherein the at least one hole diameter is substantially equal in size in to the rod diameter.

9. The method of claim 6 wherein the lip has a lip length generally parallel to the transverse bar length and further wherein the lip length is from about 0.2 inches to about 1 inch.

10. The method of claim 9 wherein the lip length is less than the transverse bar length.

11. The method of claim 1 wherein in step d), the horizontal bar does not contact the door front side.

* * * * *